US006976516B2

(12) United States Patent
Hale et al.

(10) Patent No.: US 6,976,516 B2
(45) Date of Patent: Dec. 20, 2005

(54) UNDERNEATH STYLE KNIFE CLAMP WITH REPLACEABLE CLAMP WEAR MEMBER

(75) Inventors: Roy D. Hale, Iron City, TN (US); Rickey W. Beasley, Florence, AL (US)

(73) Assignee: Metso Paper, Inc., Helsinki (FI)

( * ) Notice: Subject to any disclaimer, the term of this patent is extended or adjusted under 35 U.S.C. 154(b) by 13 days.

(21) Appl. No.: 10/421,205

(22) Filed: Apr. 23, 2003

(65) Prior Publication Data

US 2004/0211487 A1 Oct. 28, 2004

(51) Int. Cl.[7] ..... B27L 11/00

(52) U.S. Cl. ..... 144/373; 144/174; 144/176; 241/92; 241/298

(58) Field of Search ..... 144/162.1, 172–176, 144/218, 220, 373, 369, 241; 241/92, 93, 241/298, 296

(56) References Cited

U.S. PATENT DOCUMENTS 4,784,337 A 11/1988 Nettles et al.
4,887,772 A 12/1989 Robinson et al.
5,015,018 A * 5/1991 Arnoldt ..... 285/367
5,129,437 A 7/1992 Nettles et al.
5,139,063 A 8/1992 Nettles et al.
5,305,811 A * 4/1994 Schaefer ..... 144/176
5,765,452 A 6/1998 Roux et al.
5,857,508 A * 1/1999 Jonkka ..... 144/363
6,056,030 A * 5/2000 Jonkka ..... 144/176
6,148,882 A 11/2000 Nettles

* cited by examiner

*Primary Examiner*—Derris H. Banks
*Assistant Examiner*—Shelley Self
(74) *Attorney, Agent, or Firm*—Stiennon & Stiennon

(57) ABSTRACT

A two-part blade support base for mounting a chipper knife to a chipper disc wherein the parting line between the upper part and lower part is substantially parallel to a plane defined by the chipper disc. The parting line incorporates a vertical step which transmits shear forces which would cause the upper part to move outwardly of a chip receiving surface. A screw or bolt connects the upper and lower parts of the blade base. The upper part of the blade base may be constructed of a wear resistant material.

16 Claims, 2 Drawing Sheets

22
24
26
28
30
32
34
36
37
38
40
42
44
56
58
62
28
38
42
44
46
48
49
50
51
52
53
54
55
57
59
60
61
63
64
65
α

66
70
72
74
76
78
79
80
82
84
86
88
90
β

UNDERNEATH STYLE KNIFE CLAMP WITH REPLACEABLE CLAMP WEAR MEMBER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to chippers and the structures which hold the chipping knives.

The principal use of wood apart from its use as fuel and as a structural material is as a source of fiber. If the wood fibers are to be separated from the other constituents of wood, principally lignin, the wood must be chemically treated. The chemicals used, such as caustic soda, can damage the wood fibers if the wood fibers are exposed to the chemicals too long. For this reason, wood which is to be treated to extract the lignin is first reduced to wood chips which have a uniform thickness. These uniform wood chips minimize the time during which the wood fibers are exposed to the chemicals or cooking liquor. The wood chip allows the cooking liquor to act on all sides rapidly and uniformly, separating the wood fibers from the lignin of the wood. Of course the cutting of the wood into chips necessarily breaks some fibers and broken fibers have less or no value. Therefore a chipper which produces uniform chips and converts a high fraction of the raw logs to wood chips is desired. The production of wood fiber is a commodity business where profit margins are thin, so small improvements in quality, or in cost of production are the main sources of increased profitability.

Wood chippers are extremely productive machines reducing perhaps 70 to 170 cords of wood to chips in one hour. This high throughput, combined with the natural contamination of dirt and sand, results in the cutting blades and the blade supports being worn away. The blade base which is positioned directly below the cutting blades has a chip facing surface which is particularly subject to abrasion. The wood chips are actually broken into chips by colliding with this surface of the base and thus considerable wear takes place on the blade base immediately below the supported blade. One known approach is to simply replace the blade bases when they become worn, however, this adds to the cost of producing the wood chips. Another approach is to apply a surface hardening such as by flame spraying. A further approach is to weld on a piece of wear resistant material to the surface of the blade base exposed to high wear. These approaches, while extending the life of the blade bases, are undesirably labor-intensive. U.S. Pat. No. 5,765,452 describes a known technique which is to arrange a changeable blade stopper between the blade base and the blade. However U.S. Pat. No. 5,765,452 discourages using this approach. What is needed is a blade base which has a chip facing surface which can be replaced with minimal overall cost.

SUMMARY OF THE INVENTION

The chipper of this invention has a two-part blade support base wherein a parting line between the upper part and lower part is substantially parallel to a plane defined by the chipper disc and substantially perpendicular to the chip receiving surface positioned underneath a chipper blade. The parting line incorporates a vertical step which resists shear forces which would cause the upper part to move outwardly from the chip receiving surface. A screw or bolt connects the upper and lower parts of the blade base. The upper part of the blade base may be constructed of any wear resistant material.

It is a feature of the present invention to provide a blade support base in a wood chipper which can be maintained at lower overall cost.

Is a further feature of the present invention to provide a blade support base in a wood chipper which can be more readily maintained with less skilled labor.

Further objects, features and advantages of the invention will be apparent from the following detailed description when taken in conjunction with the accompanying drawings.

DESCRIPTION OF THE PREFERRED EMBODIMENTS

Figure 1:
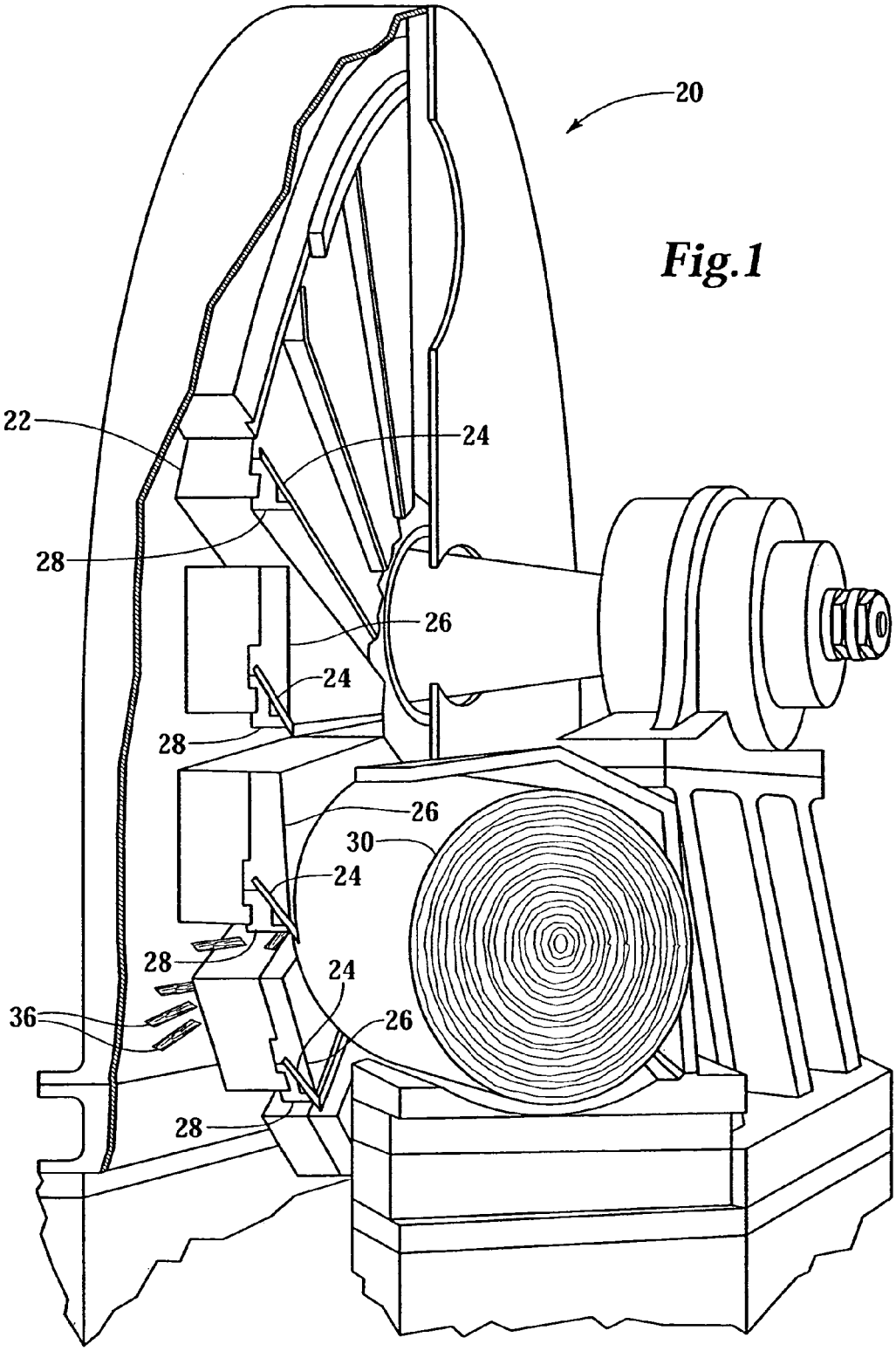
FIG. 1 is an isometric view partly cut away of a wood chipper incorporating the blade support base of this invention.

Referring more particularly to FIGS. 1–4 wherein like numbers refer to similar parts, a wood chipper 20 is shown in FIG. 1. The wood chipper 20 has a chipper disc 22 to which knives 24 are held between upper knife holders 26 and blade support bases 28. The each knife 24 has a cutting blade edge which engages a log 30 as the chipper disc rotates. The wood chipper disc 22 defines a plane in which the disc 22 rotates. Logs 30 are fed through a feed spout 32 against the chipper disc 22.

Figures 2, 3, 4:
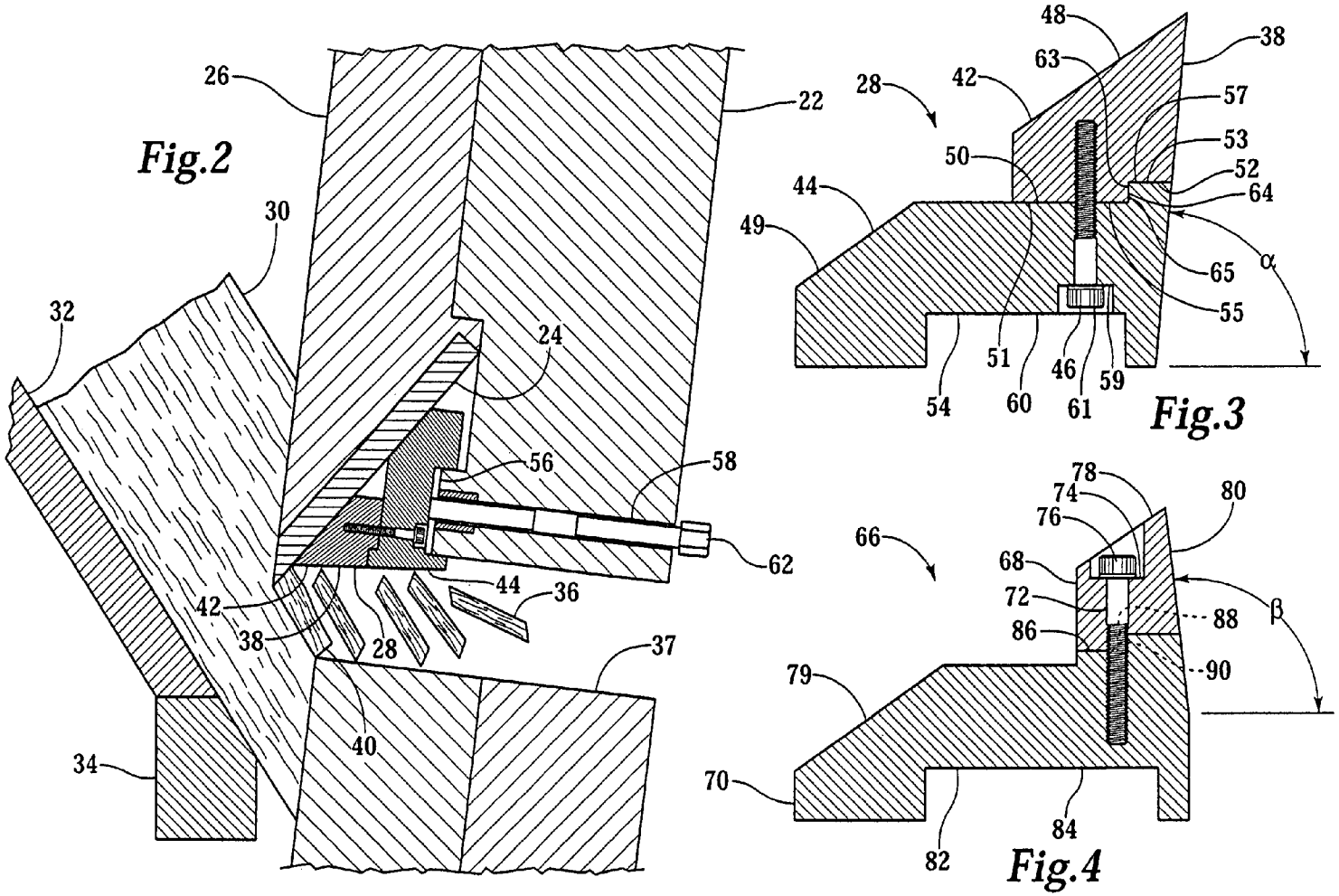
FIG. 2 is a fragmentary cross-sectional view of the blade base of this invention supporting a blade on a wood chipper disc.
FIG. 3 is an elevational cross-sectional view of the blade support base of FIG. 2.
FIG. 4 is an elevational cross-sectional view of an alternative blade support base of this invention

Cutting action takes place between the moving knife blades 24 mounted to the chipper disc 22 and a fixed bed knife 34 which holds the log 30 as wood chips 36 are cut from the log 30, as shown in FIG. 2. The wood chips 36 enter a chip slot 37 and slide along the underside of the knife blade 24 until they engage a chip facing surface 38 of the blade support base 28. Hitting the chip facing surface 38 splits the chips 36 from a larger veneer 40 which the knife blade 24 removes from the log 30. Because the wood chips 36 and a certain amount of abrasive dirt or sand move with considerable force against the chip facing surface 38, the blade bases 28 eventually wear out and require replacement or repair.

The blade base 28, as shown in FIG. 3 is constructed of three parts, an upper part 42 which engages the knife blade 24, a lower part 44 which engages the upper part and the chipper disc 22, and a screw or bolt 46 which extends from the lower part 44 the upper part 42, thus connecting the upper part 42 to the lower part 44. The upper part 42 has an upper surface 48 which supports the knife blade 24, a chip facing surface 38 which faces towards the wood chips as the chipper disc rotates, and a mating surface 50 which is substantially parallel to the plane defined by the chipper disc 22. The mating surface is opposite the upper surface 48, and faces away from the knife blade 24. The lower part 44 also has upwardly facing surface 49 which engages and supports the knife blade 24. The blade engaging surface 49 of the lower part 44, and the blade engaging surface 48 of the upper part 42 are co-planer. The surfaces 49, 48 are brought into alignment by grinding them flat when the blade base 28 is first assemble, and whenever the upper part 42 is replaced.

The mating surface 50 has a projection 55 which extends away from the knife blade, and which has a rise surface 63 extending towards the lower part 44. A recess 53 is defined adjacent the projection 55, and together the recess and the projection define a change in height or a step 52. The lower part 44 of the blade support base 28 has a complementary mating surface 51 which is positioned adjacent the mating surface 50 of the upper part 42. A projection 57 extends upwardly from the lower part 44 towards the upper part 42, and engages within the recess 53. The lower part projection 57 has a lower rise surface 65 which extends towards the upper part 42. The lower rise surface 65 is parallel to the upper rise surface 63 and engages against it.

The step 52 thus has surfaces which extend at approximately a right angle to both the chip facing surface 38 and the mating surface 50, which prevent a force of the knife holder 26 acting in the direction of rotation of the chipper disc 22 from moving the upper part 42 in a direction towards the chip facing surface 38. Thus the steps 52, 64 act to prevent the upper part 42 from shearing with respect to the lower part 44, and thus prevents a shear load on the screw or bolt 46.

The lower part 44 has a rectangular slot 54 which is received on a land 56 forming part of the chipper disc 22, as shown in FIG. 2. A threaded bolt 58 bears on a bottom surface 60 of the lower part 44 of the support base 28. The threaded bolt 58 has a hex socket head 62 which allows the bolt 58 to be rotated to raise or lower the blade base 28. The chip facing surface 38 of the blade base 28 extends across both the upper part 42 and the lower part 44, and extends outwardly at an angle $\alpha$ of about 85 degrees from the bottom surface 60, or from the plane defined by the chipper disc 22. It should be understood the angle $\alpha$ could as small as 60 degrees. The mating surfaces 50, 51 are substantially perpendicular to the bottom surface 60 and the plane defined by the disc 22.

The combination of the mating surface 50 being substantially parallel to the bottom surface 60 which is supported by the screws 46 and the step 52 which receives the complementary step 64 on the lower part 44 allows a two-part blade base 28 of the necessary structural integrity.

The screw or bolt 46 extends upwardly from the lower part 44 to engage the upper portion 42. A counterbored portion 59 of the lower part 44 positions the head 61 of the screw 46 recessed from the bottom surface 60.

An alternative embodiment blade base 66 is shown in FIG. 4. The blade base 66 has an upper part 68 and lower part 70. The upper part 68 is joined to the lower part 70 by screws 72 which extend from the upper part 68 to engage the lower part 70. The upper part 68 has a flat bottomed counterbored portion 74 which positions the head 76 of the screw below the blade support surface 78. A chip facing surface 80 is set at an inward angle $\beta$ of about 97.5 degrees inwardly of the chips slot 37 relative to the plane defined by the disc 22 or a bottom surface 82 of a rectangular slot 84. It should be understood the angle $\beta$ could be as much as 120 degrees. The rectangular slot 84 is received on the land 56 forming part of the chipper disc 22. Again, threaded bolts 58 bear on a bottom surface 82 of the lower part 70 of the support base 66. The mating surface 86 between the upper part 68 and lower part 70 on the blade base 66 again defines a step 88 on the upper part 68 which mates with a complementary step 90 formed on the lower part 70. The stepped structure comprises a feature which is arranged to resist shear forces directed toward the chip slot 37. A blade engaging surface 79 of the lower part 70, and the blade engaging surface 78 of the upper part 68 are co-planer. The surfaces 49, 48 are brought into alignment by grinding them flat when the blade base 66 is first assemble, and whenever the upper part 68 is replaced.

The upper blade base parts 42 and 68 can be cost-effectively replaced when they become worn, as the cost of wear resistant materials is substantially proportional to the weight of material used, so replacing the relatively light-weight upper parts 42, and 68 which weigh only about 20 percent–35 percent of the weight of the entire base, is substantially more cost-effective than replacing the entire blade base 28 and 66. Replacement does not require skilled labor and requires little time beyond that necessary to gain access to the blade base itself. The design of the two-part blade bases 28 and 66 is such that the screw connecting the upper parts to the lower parts is not substantially loaded. Loads in compression are taken by the mating surfaces which are parallel to the bottom surface of the bottom parts which are supported, on chipping disc 22, and shear loads are resisted by steps in the mating surfaces between the upper and lower parts.

Another advantage of replacing the upper blade base parts 42 and 46 is that the angle of the chip facing surface 38 can be changed without replacing the entire blade base. Different types of wood can benefit from the different angle $\alpha$, $\beta$ of the chip facing surface 38 which can generally be varied from 60 degrees to 120 degrees. In this way the operator of a wood chipper 20 can replace the upper blade base parts 42, 46 with an upper blade base part of a significantly different angle, to better control chip formation either because of the change of wood type, or a desire to change the chips due to a change in the way the chips are further processed. A significant change in the angle of the chip facing surface may be, for example, three to six degrees.

It should be understood that the step 52 in the mating surfaces 50, 51 between the upper part and lower part of the blade bases could be any feature which prevents shearing along the mating surfaces 50, 51, such as a ridge, or a key.

It should be understood that the upper parts 42 and 68 can be manufactured from any wear resistant material and could be constructed of for example, mild steel, high-speed steel, tool steel, special wear resistant steel alloys, tungsten carbide with a cobalt binder, titanium carbide with a nickel-molybdenum binder or a ceramic, such as silicon carbide, any metal ceramic composite, or other type of wear resistant inserts. The upper parts 42 and 68 may themselves be constructed from two or more parts, for example a tungsten carbide piece could be bonded to the chip faces 38, 80 of the upper parts 42. Thus it should be understood that the upper parts 42, and 68 can be made of any material and construction having the necessary strength and wear resistant properties.

It should be understood that the angle of the chip face may advantageously be within an angle $\alpha$ of 60 degrees to an angle $\beta$ of 120 degrees, which includes the chip face being at a 90 degree angle relative to the plane defined by the disc 22.

The upper parts 42, 68 can be joined to the lower part 44,70 by a screw or bolt which is threaded into the upper or lower part. Alternatively a spring pin, or a bolt or other mechanical arrangement can be used to join the two parts.

It is understood that the invention is not limited to the particular construction and arrangement of parts herein illustrated and described, but embraces all such modified forms thereof as come within the scope of the following claims.

We claim:

1. A blade base of a disc chipper for mounting a knife blade to a chipper disc, the blade base comprising:

a blade base upper part having a first surface for engaging a knife blade;

a blade base lower part which engages the blade base upper part, and has a chipper disc engaging portion; and at least one mechanical arrangement extends in a first direction between the upper part and the lower art to join the upper part to the lower part, and wherein a mating surface is defined on the blade base upper part and a complementary mating surface is defined on the blade base lower part, said mating surface and complementary mating surface being substantially perpendicular to the first direction, said mating surface and complementary mating surface incorporating a shear resistant feature, wherein the blade base lower part has a second surface for engaging a knife blade which is co-planer with the first surface.

2. The blade base of claim 1 wherein the shear resistant feature is a step in the mating surface and a matching step in the complementary mating surface.

3. The blade base of claim 1 wherein the blade base has a chip facing surface at least a portion of which is formed by the upper part of the blade base which is angled with respect to a plane defined by rotation of the chipper disc at an angle of between about 60 to 120 degrees.

4. The blade base of claim 1 wherein the at least one mechanical arrangement extends from the lower part to engage the upper part.

5. The blade base of claim 1 wherein the at least one mechanical arrangement extends from the upper part to the lower part.

6. A method of producing wood chips from logs in a wood chipper comprising the steps of:

mounting chipper knife blades to blade bases having first upper parts which engage the mounted knife blades and lower parts which engage a chipper disc of the chipper to form two part knife blade support bases, wherein each first upper part has a first chip facing surface against which a veneer of wood from the logs is broken into chips, wherein each first chip facing surface forms a first angle with respect to a plane defined by the chipper disc rotation, said first angle being between 60 to 120 degrees;

feeding logs into the wood chipper to form wood veneers which are broken into chips, against the first chip facing surfaces;

replacing the blade base first upper parts with blade base second upper parts, wherein the blade base second upper parts have second chip facing surfaces which forms a second angle with respect to the plane defined by the chipper disc rotation, each said second angle being between 60 and 120 degrees, and wherein the second angle differs from the first angle by more than three degrees;

mounting the chipper knife blades to the blade bases; and feeding logs into the wood chipper to form wood veneers which are broken into chips, against the second chip facing surfaces.

7. The method of claim 6 further comprising the step of before mounting the chipper knife blades, grinding the first upper parts, and the lower parts to create two-part coplanar surfaces which engage the chipper knife blades; and after the step of replacing the blade base first upper parts with the blade base second upper parts, grinding the first upper parts and the second upper parts, and the lower parts to create two-part coplanar surfaces which engage the chipper knife blades.

8. The method of claim 6 wherein at least one fastener extends between each first upper part and associated lower part to join the upper parts to the lower parts, and wherein mating surfaces are defined on the first upper parts and complementary mating surfaces are defined on the bottom parts, said mating surfaces and complementary mating surfaces being substantially parallel to the plane in which the disc rotates, each mating surface incorporating a shear resistant feature.

9. The blade base of claim 1 wherein the at least one mechanical arrangement comprises a screw or bolt.

10. The blade base of claim 1 wherein the chipper disc engaging portion defines a slot for receiving a land forming a part of a chipper disc.

11. The blade base of claim 1 wherein the at least one mechanical arrangement comprises a screw or bolt.

12. The blade base of claim 1 wherein the portions for mounting to a chipper disc define a slot for receiving a land forming a part of a chipper disc.

13. A blade base of a disc chipper for mounting a knife blade with a cutting edge to a chipper disc, the chipper disc being rotatable to engage the knife blade cutting edge with a log, the blade base comprising:

a blade base first part which has a first blade surface arranged to engage a knife blade, the blade base first part having a mating surface opposite the blade surface which faces away from the first blade surface;

a blade base second part, having a complementary mating surface, and a second blade engaging surface arranged co-planer with the first blade surface;

wherein the blade base second part has portions for mounting to a chipper disc;

at least one mechanical fastener which extends in a first direction between and connects the blade base first part to the blade base second part;

said mating surface and complementary mating surface being substantially perpendicular to the first direction, said mating surface and complementary mating surface incorporating a shear resistant feature; and wherein the shear resistant feature is a step in the mating surface and a matching step in the complementary mating surface.

14. The blade base of claim 1 wherein the blade base has a chip facing surface at least a portion of which is formed by the upper part of the blade base which is angled with respect to a plane defined by rotation of the chipper disc at an angle of between about 60 to 120 degrees.

15. The blade base of claim 1 wherein the at least one mechanical arrangement extends from the second part to engage the first part.

16. The blade base of claim 1 wherein the at least one mechanical arrangement extends from the first part to the second part.

* * * * *

UNITED STATES PATENT AND TRADEMARK OFFICE

CERTIFICATE OF CORRECTION

PATENT NO. : 6,976,516 B2
DATED : December 20, 2005
INVENTOR(S) : Don Hale et al.

It is certified that error appears in the above-identified patent and that said Letters Patent is hereby corrected as shown below:

Column 5,
Line 14, “art” should be -- part --.

Signed and Sealed this

Fourteenth Day of February, 2006

JON W. DUDAS
*Director of the United States Patent and Trademark Office*